United States Patent [19]

Simmons

[11] 4,090,492

[45] May 23, 1978

[54] FORCED AIR FURNACE WITH LIQUID HEAT EXCHANGER

[76] Inventor: James E. Simmons, 1420 S. Vermont Ave., Davenport, Iowa 52802

[21] Appl. No.: 727,285

[22] Filed: Sep. 27, 1976

[51] Int. Cl.[2] ..... F24D 9/00

[52] U.S. Cl. ..... 126/101; 165/DIG. 2; 122/20 B; 237/55

[58] Field of Search ..... 122/20 A, 20 B, 33; 237/19, 8 R, 55; 126/101; 165/DIG. 2, 163

[56] References Cited

U.S. PATENT DOCUMENTS

| | | | |
|---|---|---|---|
| 2,029,574 | 2/1936 | Knudsen | 237/19 X |
| 2,201,406 | 5/1940 | Miller | 237/19 |
| 3,720,189 | 3/1973 | Meyers | 122/13 |

*Primary Examiner*—Charles J. Myhre
*Assistant Examiner*—Theophil W. Streule, Jr.
*Attorney, Agent, or Firm*—Glenn H. Antrim

[57] ABSTRACT

A heating coil in a firebox above a burner is connected to a hot water radiator positioned between the firebox and a hot air outlet. A usual short flue pipe between the firebox and a draft diverter is replaced by a plurality of longer flue pipes of smaller diameter spaced above the firebox for transferring heat to air that is flowing to space that is being heated.

2 Claims, 1 Drawing Figure

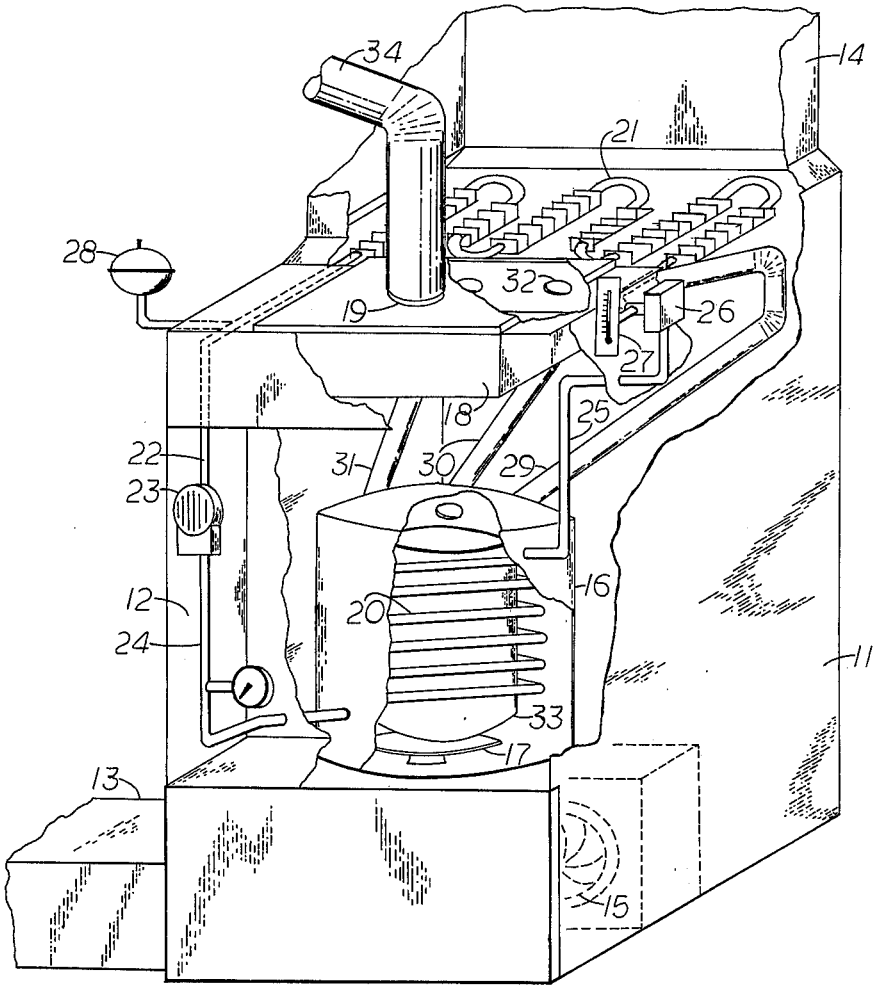
34
14
21
28
32
19
26
27
18
25
22
31
30
29
23
16
12
20
24
11
33
17
13
15

FORCED AIR FURNACE WITH LIQUID HEAT EXCHANGER

BACKGROUND OF THE INVENTION

This invention relates to hot air furnaces, and particularly to furnaces having hot water radiators in their plenums to increase the efficiency of the furnaces.

Presently, heating systems in homes most commonly use compact hot air furnaces that use either gas or oil as fuel. To increase the efficiency of the furnaces, the amounts of heat escaping with exhaust gases up the flues must be minimized. Certain systems such as that shown in U.S. Pat. No. 3,916,991 issued to George S. Trump on Nov. 4, 1975 use an extended flue with heat exchangers connected therewith for obtaining heat for the home from the flow of exhaust gas.

SUMMARY OF THE INVENTION

A usual, compact hot air furnace has two new modifications or additions to increase its efficiency and to lower the temperature of exhaust gases. A heating coil having a plurality of turns of copper tubing is mounted above the burner in the firebox and connected to a radiator. The radiator comprises a plurality of loops of conductive pipe across the space in the plenum between the firebox and hot air ducts. The short piece of pipe of rather large diameter that is usually connected between the firebox and the draft diverter, to which a flue is connected, has been replaced by a plurality of smaller pipes, for example, three pipes, connected to the draft diverter. Each of the pipes of smaller diameter have been increased in length and connect in a loop spaced in the upper part of the furnace plenum to greatly increase its radiating surface exposed to the air flowing to space to be heated. In a hot air furnace with the additional heat exchangers, air from the cold air duct flows upwardly over the firebox, then over the extended pipes for the exhaust gas, and finally over the radiator that is connected to heating coils in the firebox before entering the hot air ducts.

BRIEF DESCRIPTION OF THE DRAWING

The single FIGURE is a perspective view of a hot air furnace having portions of its casing cut away to show the hot water radiating system and divided flue system of this invention.

DESCRIPTION OF THE PREFERRED EMBODIMENT

Basically, before the new heat exchangers are added, the furnace shown in the accompanying drawing is a conventional type having a blower to increase the flow of air in the same direction that it would flow by convection alone. A cold air duct 13 is connected at the bottom of the plenum 12 of the furnace, and a hot air outlet or outlet plenum 14 extends from the top of the casing 11 at the upper end of the furnace. The lower part of the furnace is divided into a compartment that contains a fan 15 for propelling air from the cold air duct 13 upwardly through the furnace plenum 12 into the hot air outlet plenum 14. The furnace has a conventional burner 17 positioned below a cylindrical firebox 16 centrally located in the furnace plenum 12. A draft diverter 18 attached to the upper front portion of the furnace has a collar 19 to which a flue 34 is connected.

The casing 12 has been cut away to show heat exchangers added to the furnace. One of the heat exchangers is to be filled with water or other liquid and transfers heat from the space just above the burner 17 to the top of the furnace plenum 12. A helical heating coil 20 having its axis vertical comprises a plurality of turns of conductive pipe coaxially positioned within the firebox 16 with the lower turn a short distance above the burner 17. The cylindrical heat deflector 33 may be coaxially positioned within the turns to direct the flame and heat of the burner 17 to the turns of the coil.

The heating coil 20 is connected to a radiator 21 having a plurality of loops of finned tubing. The loops of the radiator 21 are spaced across the upper part of the furnace plenum 12 or in the lower part of the outlet plenum 14, between the firebox 16 and hot air ducts (not shown) connected to the outlet plenum 14. One end of the pipe of the radiator 21 is connected through the pipe 22 to the inlet of a water pump 23. The outlet of the water pump is connected through a length of pipe 24 to the lower end of the conductive pipe making up the heating coil 20. The upper end of the heating coil 20 is connected through a piece of pipe 25 to the inlet of the radiator 21. A pressure and temperature sensitive switch 26 has a thermally conductive connection to the pipe 25, and a switching circuit of the switch 26 is connected to a fuel valve for shutting off the fuel to the burner 17 when the temperature or pressure reaches upper predetermined limits. A thermometer 27 is also connected to the pipe 25. An expansion chamber 28 is connected to the pipe 22 to allow for moderate expansion of the liquid within the heating coil 20 and the radiator 21 as the liquid becomes warmer. If the amount of expansion exceeds the capacity of the expansion chamber 28, the switch 26 operates to prevent the pressure within the fluid heat exchange system from becoming dangerously excessive.

The short flue pipe of quite large diameter that ordinarily is connected between the upper end of the firebox 16 and the draft diverter 18 has been replaced by a plurality of smaller pipes that have been lengthened and spaced within the upper part of the furnace plenum 12 for transferring heat from the pipes to the air that is circulated up through the plenum. As shown in the drawing, pipes 29, 30, and 31 are connected in a loop arrangement from the upper portion of the firebox 16 that faces the rear of the furnace in an upwardly and forwardly direction to inlets 32 spaced along the rear wall of the draft diverter 18.

By adding the liquid heat exchanger and using a plurality of flue pipes according to this invention, the temperature of the exhaust gases as they enter the draft diverter 18 are much lower than the temperature of the escaping exhaust of gases in typical furnaces. Heat from the flame has been absorbed by the heating coil 20 such that the temperature at the upper end of the firebox 16 has been decreased and additional heat is transferred from the flue pipes 29–31 to the air that passes to the hot air ducts and the space that is to be heated. The heat exchangers can be added to the usual furnace, and when a furnace is the counterflow type, the radiator 21 can be placed within the bottom portion of the furnace plenum.

I claim:

1. In a hot air furnace of the type having a firebox, said firebox having a lower portion containing a burner for introducing a flame within said firebox, a draft diverter spaced above said firebox, said firebox having an upper portion with exhaust means connected to said draft diverter, a furnace plenum surrounding said firebox, a hot-air outlet and an air-return duct connected to respective opposite ends of said plenum; a liquid heat exchanger for improving the efficiency of said furnace comprising:

a heating coil comprising a plurality of spaced turns of pipe positioned within said firebox above said burner, a radiator comprising spaced turns of pipe across said furnace plenum between said firebox and said hot-air outlet, and said heating coil and said radiator being interconnected to form a continuous circulatory system.

2. A hot-air furnace as claimed in claim 1 wherein said draft diverter has a plurality of inlets, said exhaust means includes a plurality of spaced outlets through said upper portion of said firebox and a plurality of spaced exhaust pipes of heat conductive material, each of said exhaust pipes being connected between a respective one of said outlets of said firebox and a respective one of said inlets of said draft diverter, and each of said exhaust pipes having the configuration of a loop extending substantially across said furnace plenum between said firebox and said draft diverter.

* * * * *